United States Patent [19]

Kahn et al.

[11] 4,228,737

[45] Oct. 21, 1980

[54] GLIDE BOMB

[75] Inventors: Marvin J. Kahn; Robert J. Malchodi; Joseph P. Paine; Milton J. Rogers, all of Baltimore; Robert L. Zouck, Pikesville, all of Md.

[73] Assignee: AAI Corporation, Cockeysville, Md.

[21] Appl. No.: 465,015

[22] Filed: Oct. 27, 1954

[51] Int. Cl.[3] ..... F42B 25/06

[52] U.S. Cl. ..... 102/3

[58] Field of Search ..... 102/2, 9, 3, 50; 244/14, 49, 3.1

[56] References Cited

U.S. PATENT DOCUMENTS

| | | | |
|---|---|---|---|
| 1,448,166 | 3/1923 | Strong | 244/3.29 |
| 1,739,798 | 12/1929 | McCrea | 244/49 |
| 2,343,645 | 3/1944 | Dickinson et al. | 244/49 |
| 2,348,240 | 5/1944 | Braun | 102/2 |
| 2,424,193 | 7/1947 | Rost et al. | 102/3 |

FOREIGN PATENT DOCUMENTS

| | | | |
|---|---|---|---|
| 262445 | 7/1913 | Fed. Rep. of Germany | 244/3.29 |
| 582843 | 11/1946 | United Kingdom | 102/3 |
| 686646 | 1/1953 | United Kingdom | 244/49 |

*Primary Examiner*—Charles T. Jordan

*Attorney, Agent, or Firm*—Reginald F. Pippin, Jr.

EXEMPLARY CLAIM

1. A glide bomb adapted to be carried in the bombay of an aircraft and released to glide along a predetermined path to a selected target for scattering units of destructive material over a relatively large area comprising, an elongated fuselage, a sustaining wing carried by said fuselage, said sustaining wing comprising a plurality of hinged panels foldable about said fuselage, means responsive to releasing said bomb for moving said panels into alignment for sustaining said bomb, control members carried by said wing, gyro controlled means carried by said bomb and connecting with said control members for actuating the latter whereby to cause said bomb to glide along said predetermined path, tail fins carried by said fuselage for stabilizing the bomb, means for releasing the sustaining wing at the end of the glide path, and means for canting said tail fins to cause said fuselage to spin about its longitudinal axis and impart a radial velocity to the units of destructive material when said fuselage is released from said wing.

7 Claims, 9 Drawing Figures

GLIDE BOMB

This invention relates generally to aircraft and more particularly to a glide bomb having folding wings and control means providing automatic operation.

An object of this invention is to provide a bomb with wings for increasing the lateral range thereof during its descent whereby the aircraft from which the bomb is released is not required to fly directly over the target.

Another object of this invention is to provide a glide bomb with folding wings which are movable from a stowed position to a load sustaining position whereby the glide bomb may be conveniently carried in the bombay of an aircraft like a conventional wingless bomb.

Another object of this invention is to provide a glide bomb having means for automatically controlling the movement of the wings and control surfaces to effect movement of the bomb along a selected path towards the target.

Still another object of this invention is to provide a glide bomb having means for automatically releasing the load sustaining wings and causing the bomb to spin about a nearly vertical axis over the target whereby a horizontal velocity is imparted to the destructive material when released, causing it to scatter over a relatively large area.

Further and other objects will become apparent from a reading of the following detail description especially when considered in combination with the accompanying drawing wherein like numerals refer to like parts.

Figure 1:
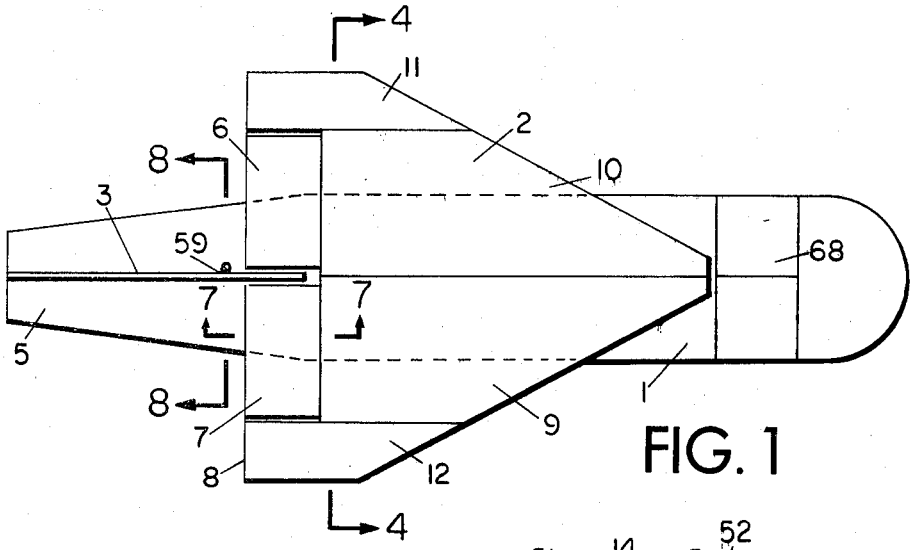
FIG. 1 is a plan view of the glide bomb.
Figure 2:
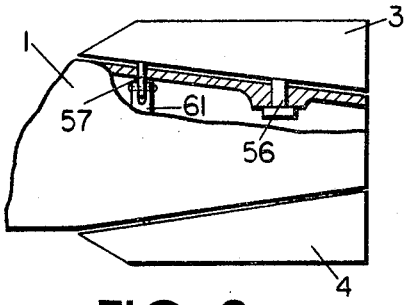
FIG. 2 is a fragmentary side view of the tail portion of the bomb.

The glide bomb as shown in FIG. 1 includes an elongated fuselage or housing 1 and a delta shaped wing 2. The purpose of employing the wing is to produce a lifting force when the bomb is dropped which will cause the bomb to glide earthward towards the target along a prescribed path which may have a sizable horizontal or lateral component. Thus the carrier aircraft is not required to fly directly over the target but may instead fly a course off the target calculated to avoid enemy interference. A pair of vertical fins 3 and 4 are provided as best shown in FIG. 2 which are secured to housing 1 on the tail portion 5 thereof for stabilizing the bomb in yaw during flight and for producing a couple causing rotational movement of the bomb at the end of the flight for dispensing destructive material as hereinafter more fully described.

A pair of elevons 6 and 7 swingably carried by wing 2 adjacent the trailing edge 8 thereof produce the aerodynamic control forces required to guide the bomb along a prescribed path. These elevons serve to control the bomb both in pitch and in roll. The direction of flight is controlled exclusively by varying the bank angle or roll position of the bomb through the use of the elevons. By this means the bomb may be made to glide along any desired path in all planes.

Figure 3:
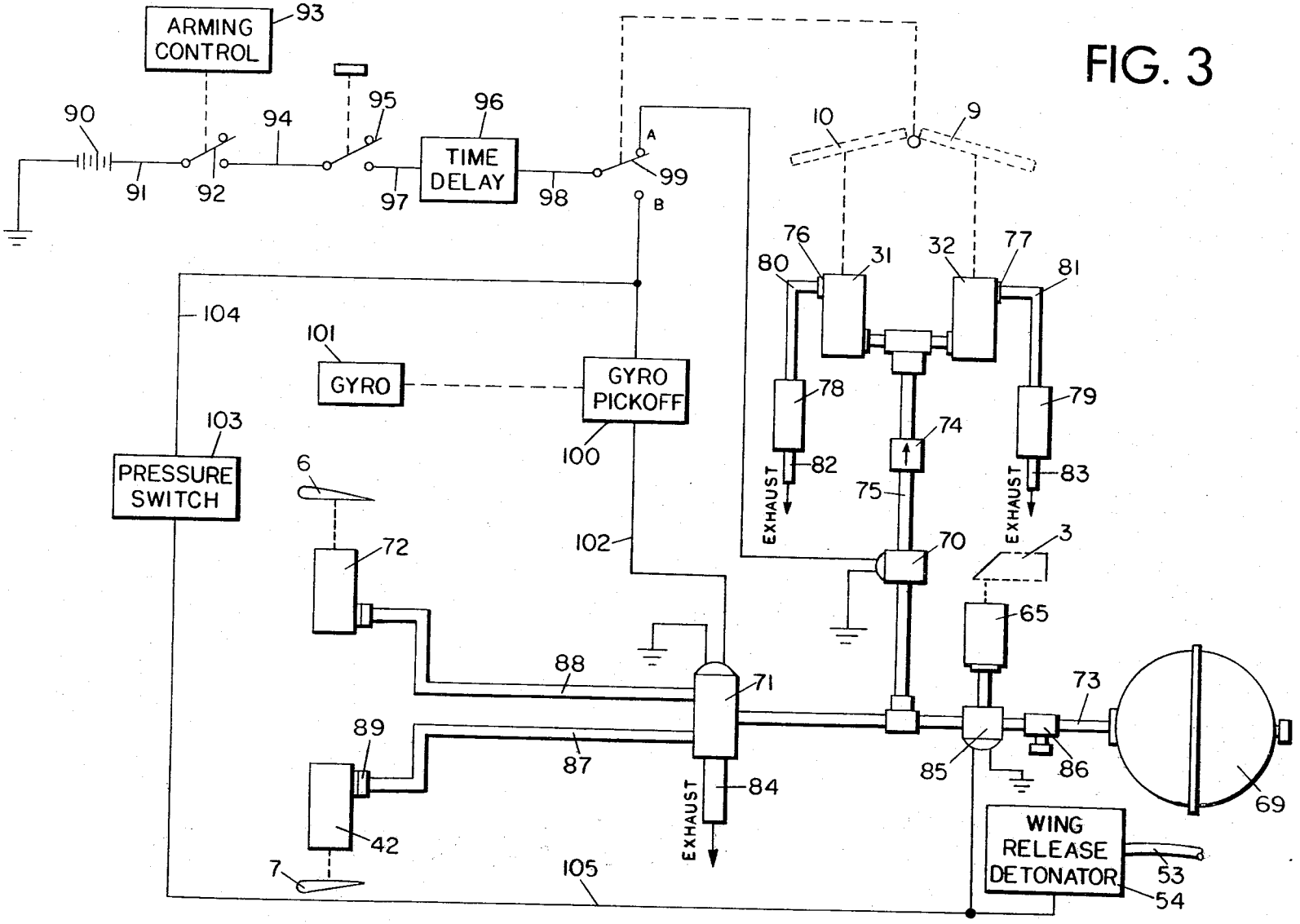
FIG. 3 is a schematic diagram of the control system.

The bomb employes a combination electrical and hydraulic system, as shown in FIG. 3, which is fully automatic in operation for performing the control functions necessary to carry out the bombing techniques. While the complete control system is shown only schematically in FIG. 3, the actual physical construction and arrangement of those essential components of the bomb which are necessary to fully understand the invention are shown in FIGS. 1 and 2 and 4 through 9.

Figure 5:
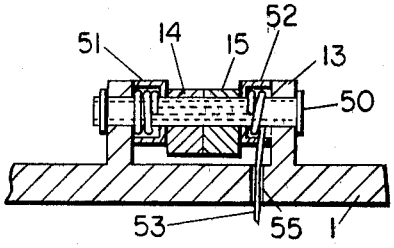
FIG. 5 is a sectional view taken on line 5—5 of FIG. 4.
Figure 4:
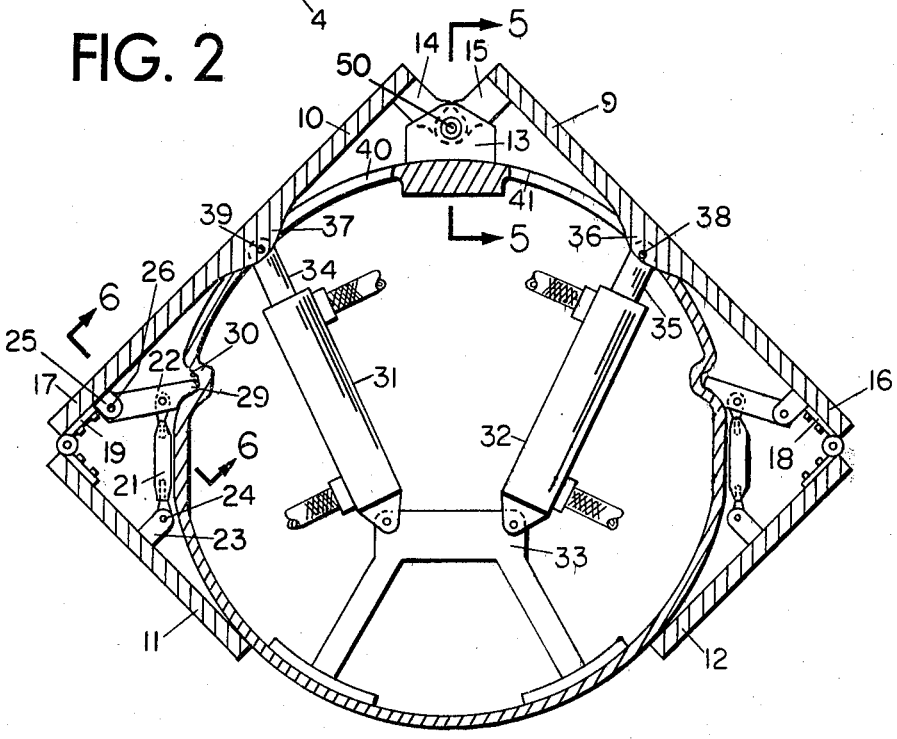
FIG. 4 is a sectional view of the glide bomb showing the wing in stowed position taken approximately on line 4—4 of FIG. 1.

Wing 2 is composed of a pair of inner panels 9 and 10 and a pair of outer panels 11 and 12 as shown in FIGS. 1 and 4. Inner panels 9 and 10 are swingably carried by housing 1 through a plurality of brackets 13 as shown in FIGS. 4 and 5. Hinge members 14 and 15, rigidly carried by panels 9 and 10 and projecting downwardly therefrom in a generally normal direction relative to the plane of the panel, engage pins 50 carried by brackets 13 so that the panels may swing from an aligned load sustaining position shown in FIG. 1 to a stowed position shown in FIG. 4, lying closely adjacent housing 1. The length of hinge members 14 and 15 are such that when the inner wing panels fold to the stowed position they are at right angles to each other. Brackets 13 are rigidly connected to housing 1 to provide a hinge line for the wing panels which is axially aligned parallel with the longitudinal axis of the housing. The span of each panel 9 and 10 is substantially equal to the diameter of the housing.

Outer panels 11 and 12 connect with the tip ends 16 and 17 of panels 9 and 10 through hinges 18 and 19 for movement from a load sustaining position generally aligned with panels 9 and 10 to a stowed position generally normal to the inner panels and lying closely adjacent housing 1. With the wing in the stowed position as shown in FIG. 4, a very compact package is obtained, allowing the bomb to be handled and carried in substantially the same manner as a conventional bomb of approximately the same size.

Figure 6:
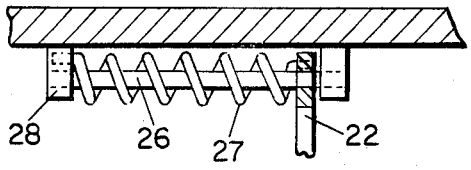
FIG. 6 is a sectional view taken on line 6—6 of FIG. 4.

A mechanical locking mechanism is associated with each outer panel 11 and 12 for locking the panels in the stowed position, and for automatically causing it to swing to the aligned load sustaining position and be locked, in response to movement of the inner panels towards the aligned load sustaining position. This locking mechanism includes a toggle linkage represented by arms 21 and 22. Arm 21 is adjustable in length and connects with a bracket 23 on the underside of the outer panel through pin 24. Arm 22 connects with a bracket 25 on the underside of the inner panel through pin 26. As shown in FIG. 6, arm 22 engages a torsion spring 27 concentrically arranged relative to pin 26. Spring 27 is anchored at one end to a bracket 28 on the inner panel which cooperates with bracket 25 to support pin 26. Due to the action of spring 27, arm 22 is constantly urged to rotate in a clockwise direction as viewed in FIG. 4. When released, arm 22 causes the outer panel to swing into alignment with the inner panel and positions the toggle into a past dead center position preventing movement of the outer panel back to the stowed position. A projection 29 on arm 22 may be adapted to engage a detent 30 formed in the side of housing 1 when the wing is stowed, preventing movement of the outer panel out of the stowed position until the inner panel is swung about its hinge line towards the aligned load sustaining position a sufficient amount to free arm 22.

Since the outer panels move to the aligned load sustaining position automatically in response to movement of the inner panels, it is only necessary to provide actuating means for controlling the movement of the inner panels. To accomplish this, a pair of hydraulic cylinders 31 and 32 are employed, one for each inner panel 9 and 10. Cylinders 31 and 32 are swingably carried by a bracket 33 forming a part of housing 1. The actuating rods 34 and 35 of cylinders 31 and 32 extend through slotted openings 40 and 41 in housing 1 to connect with brackets 36 and 37 on inner panels 9 and 10 by means of pins 38 and 39. By actuating hydraulic cylinders 31 and 32 as hereinafter described, wing 2 is made to move to the generally aligned load sustaining position shown in FIG. 1.

Figure 7:
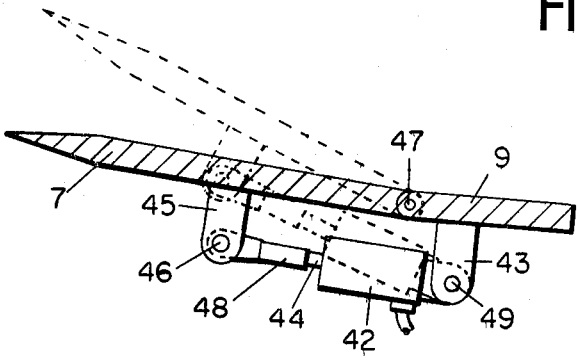
FIG. 7 is a sectional view taken approximately on line 7—7 of FIG. 1.

Elevons 6 and 7 carried by wing 2 at the trailing edge 8 of inner panels 9 and 10 are hydraulically actuated as best shown in FIG. 7 to provide both lateral control and pitch control. A hydraulic cylinder for each elevon such as cylinder 42 associated with elevon 7 is swingably carried by a bracket 43 rigidly secured to inner wing panel 9. Actuating rod 44 of cylinder 42 connects with a second bracket 45 secured to elevon 7 through pin 46. By actuating hydraulic cylinder 42, rod 44 is caused to move axially outward relative to the cylinder and thereby move the elevon about its hinge pin 47 from the lowermost position to the uppermost position as indicated by dotted lines in FIG. 7. If elevon 7 is raised by actuating cylinder 42, the aerodynamic lift on the right side of the wing is reduced and the bomb rolls in a clockwise direction in response to this unbalanced aerodynamic moment. When the bomb is stabilized with its left wing up it will turn right. If elevon 6 is raised instead of elevon 7, the lift produced by the left side of the wing is reduced and the bomb rolls in a counterclockwise direction. When the bomb is stabilized with its right wing up it will turn left.

While lateral control of the bomb is obtained by sequentially actuating elevons 6 and 7, pitch control is obtained from the net force produced by the average deflection of both elevons. In order to change this average elevon deflection and hence the pitching moment, it is only necessary to shift the mean of the elevon travel range up or down. This may be done by removing pin 46 and rotating coupling 48 which threadedly engages actuating rod 44 so as to increase or decrease the distance between pin 46 and pin 49 on bracket 43. Though it is not necessary for the operation of the glide bomb described herein, if it should be desired to provide means for changing the pitch control adjustment in flight, it may be done by simply shifting bracket 43 fore and aft as desired rather than by changing the effective length of rod 44 as described above.

At the end of the glide path, it is desired to release wing 2 and immediately start the bomb spinning about its longitudinal axis for imparting a radial velocity to the destructive material released therefrom. The means for releasing wing 2 is best shown in FIG. 5 wherein a hollow pin 50 is employed for transmitting the forces between wing 2 and housing 1 through hinge members 14 and 15 and bracket 13. Hollow spacers 51 and 52 are carried by pin 50 on either side of hinge members 14 and 15 to provide annular cavities adapted to receive a suitable explosive such as Primacord for shearing the pin. One continuous piece of Primacord 53 is fed from a detonator 54 inside housing 1 as indicated in FIG. 3, through an opening 55 in housing 1 as shown in FIG. 5 and into the cavity provided by spacer 52 where it is wound around pin 50. From spacer 52 the Primacord is fed to spacer 51 through hollow pin 50 and again wound therearound. Pins 38 and 39 connecting cylinders 31 and 32 with wing panels 9 and 10 are similarly wound with primacord. All of the pieces of primacord are then connected together so as to explode simultaneously upon actuation of detonator 54. The force of the explosion causes pins 38, 39 and 50 to fail and release wing 2 from the housing.

Figure 8:
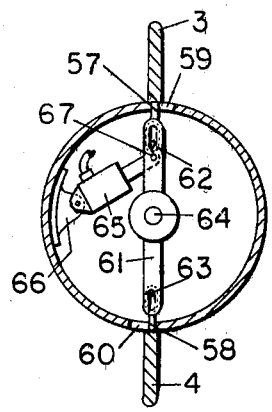
FIG. 8 is a sectional view taken on line 8—8 of FIG. 1.

Tail fins 3 are swingably carried by housing 1 through pin 56 as best shown in FIG. 2. The fins are positioned relative to the longitudinal axis of housing 1 by means of guide members 57 and 58 which project into the housing through slots 59 and 60 as best shown in FIG. 8. A lever 61, centrally pivoted within housing 1 connects with guide members 57 and 58 through pins 62 and 63 so that rotational movement of the lever about its hinge pin 64 will cause fins 3 and 4 to move within the limits of slots 59 and 60 from a stabilizing position aligned with the longitudinal axis of the housing to a spin position angularly offset from the longitudinal axis thereof. A hydraulic cylinder 65, swingably carried within housing 1 by bracket 66, connects with lever 61 through pin 67 for controlling the movement of the lever and hence the movement of fins 3 and 4. Cylinder 65 is of the spring loaded type which is normally urged into the retracted position shown in FIG. 8. Only upon the application of hydraulic pressure will the cylinder allow rotation of lever 61 to move fins 3 and 4 to the spin position.

Automatic control of the glide bomb is effected by the system schematically shown in FIG. 3. An accumulator 69 provides a pressurized reservoir for the storage of hydraulic fluid required to operate the hydraulic cylinders in the vehicle. The pressurized hydraulic fluid from accumulator 69 is fed through line 73 to a two-way normally closed solenoid actuated hydraulic valve 70 controlling the flow of fluid to wing cylinders 31 and 32 and to a four-way solenoid actuated hydraulic valve 71 controlling the flow of fluid to the right and left elevon cylinders 42 and 72 respectively.

A check valve 74 is provided in the output line 75 from valve 70 allowing only unidrectional fluid flow into hydraulic cylinders 31 and 32. By this means, the wing, once raised to the aligned load sustaining position, is held in that position by the fluid trapped in cylinders 31 and 32.

To insure raising both wing panels 9 and 10 at the same rate irrespective of the aerodynamic forces applied thereto so that they will reach aligned position simultaneously, cylinders 31 and 32 are filled with fluid when in the retracted position shown in FIG. 4. Actuation of the cylinders is thereby made dependent not only upon energizing valve 70 to apply hydraulic fluid from reservoir 69, but also upon the rate at which the fluid is allowed to flow out of cylinders 31 and 32 through vent ports 76 and 77. To control this flow of fluid so that the same quantity is removed from the cylinders during any given time interval, flow regulators 78 and 79 are connected thereto by fluid lines 80 and 81. As fluid is forced into cylinders 31 and 32 from the accumulator, the fluid already in the cylinders is forced to flow into regulators 78 and 79. Since the regulators maintain the quantity of fluid removed from one cylinder equal to the quantity of fluid removed from the other cylinder, both will operate alike even though the aerodynamic forces applied to panels 9 and 10 are different. Those skilled in the art will recognize that flow regulators are conventional devices that maintain a constant rate of flow of fluid therethrough in the presence of varying inlet and back pressures. By calibrating flow regulators 78 and 79 in pairs, the regulators can maintain substantially equal the rate at which fluid is removed from each cylinder. Flow regulators 78 and 79 may be constructed similar to and would operate like the paired flow restrictor valve assemblies disclosed and claimed in U.S. Pat. No. 2,307,949 to M. J. Phillips granted Jan. 12, 1943. The fluid forced out of cylinders 31 and 32 and into regulators 78 and 79 is exhausted to the atmosphere through fluid lines 82 and 83.

Elevons 6 and 7 operate differentially on the "bang-bang" principle. That is, when one elevon is up the other one is down. Control is obtained by regulating the amount of time that the elevons are held in one of the two extreme positions. This is done by controlling the flow of fluid into elevon cylinders 42 and 72. The solenoid valve 71 is a two-position, four-way valve, which in the unenergized condition allows fluid flow into cylinder 42 and connects cylinder 72 to exhaust line 84. When energized, valve 71 allows fluid flow into cylinder 72 and connects cylinder 42 to exhaust line 84. Those skilled in the art will recognize that valve 71 is a standard valve readily available in the trade, and is operable in a well known and conventional manner. Thus when valve 71 is unenergized elevon 7 is in the up position and elevon 6 is down to produce a rolling moment in one direction and when valve 71 is energized elevon 6 is up and elevon 7 is down to produce a rolling moment in the opposite direction. The elevons automatically move to the down position when fluid pressure is removed from the actuating cylinders because of the forces produced by the airflow characteristics over the wing.

Fluid lines 87 and 88 connecting valve 71 with elevon cylinders 42 and 72 are each provided with a suitable means for instant release from their respective cylinders such as a quick release coupling 89 located adjacent the cylinder. The quick release couplings are operative in response to a tension force of a predetermined magnitude for being released from the cylinders so as not to restrain the wing when released from the housing.

A solenoid actuated three-way valve 85 is interposed between accumulator 69 and valves 70 and 71. In the unenergized condition, valve 85 allows fluid to flow to valves 70 and 71, but when energized it connects the accumulator output with cylinder 65 for canting fins 3 and 4 and prevents fluid flow to valves 70 and 71.

Suitable means such as filler valve 86 is provided for filling the accumulator with an ample quantity of hydraulic fluid.

The electric current required for energizing valves 70, 71, and 85 is obtained from a suitable power supply such as battery 90. Output lead 91 from battery 90 connects with a switch 92 adapted to be actuated remotely by an arming control device 93 such as a relay circuit controlled from the cockpit of the carrier aircraft. Output lead 94 from switch 92 connects with a safety switch 95 which is mechanically actuated only by releasing the glide bomb from its supporting rack. A time delay network 96 connects with switch 95 through lead 97 for delaying current flow from battery 90 until the bomb has dropped free of the carrier aircraft. Output 98 of delay network 96 is applied to a microswitch 99 which is actuated by the movement of wing panels 9 and 10. When panels 9 and 10 are in stowed position, switch 99 is in position A, completing a circuit from delay network 96 to solenoid valve 70 controlling the flow of fluid to wing cylinders 31 and 32. When panels 9 and 10 are moved to the aligned load sustaining position, switch 99 is actuated to move the contact to position B and complete a circuit from delay network 96 to a gyro pickoff unit 100. Gyro pickoff 100 is a switch type mechanism, the contacts of which are controlled by a roll gyro 101. The gyro provides a plane of reference for the bomb control system which will remain fixed in space irrespective of the roll position of the bomb. Any roll deviations of the bomb from the plane of reference set up by the gyro are sensed by gyro pick-off 100. Roll in one direction relative to the reference plane opens the circuit through the gyro pick-off unit while roll in the opposite direction closes the circuit to energize solenoid valve 71 through lead 102. When valve 71 is unenergized, elevon 7 is in the up position rolling the glide bomb to the right. When valve 71 is energized, elevon 6 is caused to move to the up position and elevon 7 is allowed to move to the down position, producing a rolling moment in the opposite direction, rolling the glide bomb to the left.

Electrical energy from battery 90 is applied to a pressure switch 103 through microswitch 99 and lead 104 when the microswitch is in position B feeding energy to gyro pickoff 100. The pressure switch is responsive to atmospheric pressure for completing a circuit through lead 105 to wing release detonator 54 and to solenoid valve 85. When the electrical current is applied to detonator 54, primacord 53 is burned to release wing 2 from housing 1 as hereinbefore described. Simultaneously with the release of wing 2, valve 85 is energized directing the fluid from accumulator 69 to cylinder 65 for canting tail fin 3 and 4 and cutting off fluid flow to both valves 70 and 71.

Figure 9:
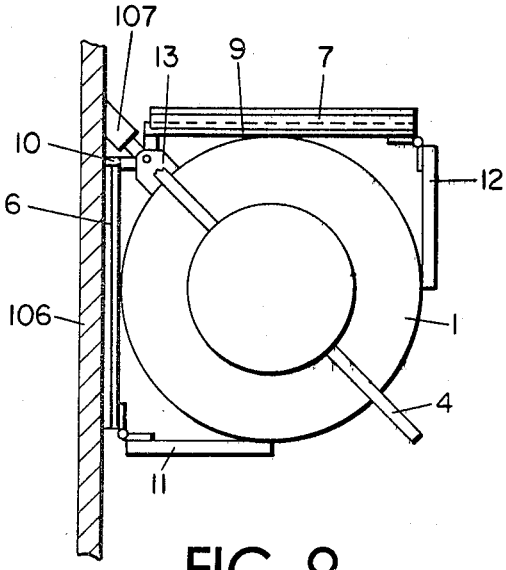
FIG. 9 is a view showing the glide bomb mounted on an aircraft bomb rack.

The glide bomb is adapted to be carried in the bombay of an aircraft in the same manner as a conventional bomb. With the wing in stowed position as shown in FIG. 9 the space requirements for the glide bomb is substantially the same as for a conventional bomb of the same diameter and length. One of the inner wing panels of the bomb such as panel 10 is arranged generally parallel with wall structure 106 of the bombay by rotating the bomb about its longitudinal axis approximately 45° from the level flight position. A conventional bomb hook 107 supportingly engages the bomb housing for carrying the bomb inside the carrier aircraft while being transported to a location near the target. When it is desired to release the glide bomb, the arming control device 93 is first actuated closing switch 92. Then the bomb is released from the hook, causing switch 95 to close and complete a circuit from battery 90 to time delay network 96. After a sufficient length of time has elapsed for the glide bomb to fall free of the aircraft, the time delay network allows the electrical energy from battery 90 to energize solenoid valve 70. With valve 70 energized fluid from accumulator 69 is forced into wing cylinders 31 and 32 to raise the wing panels from the stowed position to the axially aligned load sustaining position. The fluid initially stored in cylinders 31 and 32 is forced through flow regulators 78 and 79 to insure that the wing panels are raised at the same rate as hereinbefore described. When the wing panels reach the aligned position, microswitch 99 is actuated to move from position A to position B, de-energizing valve 70 and completing a circuit to gyro pickoff 100 and to pressure switch 103. Check valve 74 prevents the fluid in cylinders 31 and 32 from leaking back and loading valve 70. Should excessive down loads be applied to the wing or should cylinders 31 and 32 develop a slight leak causing the wing panels to swing towards the stowed position, micro-switch 99 will move back to position A and energize valve 70 long enough to correct the condition and automatically return to position B.

When the bomb is dropped from the carrier aircraft it is in a roll position 45° from the level flight position as is apparent from FIG. 9. This condition is promptly rectified as soon as the wings are erected. For example, should the bomb roll to the right beyond the roll position dictated by gyro 101, gyro pickoff 100 calls for corrective elevon such as will complete a circuit from battery 90 to valve 71 causing it to become energized for raising elevon 6. As elevon 6 is raised, elevon 7 is lowered by the air flowing over the wing. This produces a rolling moment in the counterclockwise direction, rolling the bomb towards the correct position. As the bomb again starts to roll beyond the desired position dictated by gyro 101, pickoff 100 opens the circuit to valve 71, causing elevon 7 to move to the up position and allowing elevon 6 to move to the down position. Valve 71 is turned off and on in this manner throughout the flight as the bomb oscillates in roll about the roll position dictated by the gyro.

When the glide bomb has reached a predetermined lower altitude, suitable means such as pressure switch 103 is actuated by atmospheric pressure, completing a circuit from battery 90 to detonator 54 and solenoid valve 85. This immediately releases wing 2 from bomb housing 1 and causes tail fins 3 and 4 to shift angularly out of alignment with the longitudinal axis of the housing. As a result, the canted tail fins produce a couple causing the bomb to spin about its longitudinal axis at a rate proportional to the downward velocity. At some predetermined condition such as when the spin rate has reached a certain value or when the desired altitude is reached, the destructive material is released through a suitable opening provided by the removal of cover 68 forming a part of the fuselage as shown in FIG. 1. The centrifugal force produced by the spinning bomb imparts a radial velocity to the destructive material causing it to be scattered over a wide area.

The glide bomb will fly along a path determined by roll gyro 101. If the gyro is positioned for level flight the bomb will follow a straight trajectory. If the gyro is positioned for a certain roll or bank angle the bomb will follow a curved trajectory having a radius of curvature depending upon the bank angle. The particular trajectory desired of course depends upon the flight plan selected for the carrier aircraft and is one which will most likely avoid enemy interference.

If desired, the gyro may be made responsive to signals transmitted from the carrier aircraft or the like for its position setting. In which case, the glide bomb will be caused to maneuver along a path dictated by the transmitted signals rather than along a pre-set course.

The term "glide bomb" as used herein is to be construed broadly to include any type of bomb or missile including those equipped for powered flight.

While a specific embodiment of the invention has been shown and described, it is to be understood that certain alterations, modifications and substitutions may be made without departing from the spirit and scope of the invention as defined by the appended claims.

We claim:

1. A glide bomb adapted to be carried in the bombay of an aircraft and released to glide along a predetermined path to a selected target for scattering units of destructive material over a relatively large area comprising, an elongated fuselage, a sustaining wing carried by said fuselage, said sustaining wing comprising a plurality of hinged panels foldable about said fuselage, means responsive to releasing said bomb for moving said panels into alignment for sustaining said bomb, control members carried by said wing, gyro controlled means carried by said bomb and connecting with said control members for actuating the latter whereby to cause said bomb to glide along said predetermined path, tail fins carried by said fuselage for stabilizing the bomb, means for releasing the sustaining wing at the end of the glide path, and means for canting said tail fins to cause said fuselage to spin about its longitudinal axis and impart a radial velocity to the units of destructive material when said fuselage is released from said wing.

2. A glide bomb adapted to be carried in the bombay of an aircraft and released to glide to a selected target along a predetermined path comprising, an elongated fuselage, a sustaining wing carried by said fuselage, said wing including a plurality of hinged panels arranged to swing from a stowed position closely adjacent the fuselage to a generally aligned load sustaining position, actuating means for swinging said panels to the generally aligned load sustaining position, switch means responsive to releasing said bomb for automatically operating said actuating means, aerodynamic control members swingably carried by said wing adjacent the trailing edge thereof, gyro control means connecting with said control members for actuating the same whereby to cause said bomb to glide along a predetermined path, switch means responsive to movement of said panels to the generally aligned bomb sustaining position for automatically energizing said gyro control means, and a plurality of fins carried by said fuselage adjacent one end thereof for aerodynamically stabilizing the bomb.

3. A glide bomb adapted to be carried in the bombay of an aircraft and released to glide to a selected target along a predetermined path and scatter destructive material over a relatively large area comprising, a fuselage, a sustaining wing carried by said fuselage, control surfaces swingably carried by said wing adjacent the trailing edge thereof, gyro means carried within said fuselage for actuating said control surfaces to cause said bomb to glide along a predetermined path, stabilizing fins carried by said fuselage adjacent one end thereof, means for releasing said sustaining wing at the end of the glide path, and means responsive to release of said sustaining wing for fixedly canting said fins whereby said fuselage is caused to spin about its longitudinal axis for imparting a radial velocity to the destructive material released by the bomb.

4. A missile comprising, a fuselage, a plurality of wing panels swingably carried by said fuselage for movement from a stowed position closely adjacent said fuselage to a load sustaining position spaced from said fuselage, pressure means carried by said fuselage and connecting with said panels for controlling the movement thereof, regulating means for limiting the rate of operation of said pressure means thus minimizing the effect of external forces applied to said panels on the rate of movement of said panel a pair of control members swingably carried by said panels adjacent the trailing edge thereof, actuating means operatively connecting with said control members, a control valve for alternately connecting each of said actuating means, means connecting with said valve and operative for energizing said valve whereby to control the movement of said control members for guiding said missile and stabilizing fins carried by said fuselage for aerodynamically stabilizing said missile.

5. A missile comprising, a fuselage, a plurality of wing panels swingably carried by said fuselage for movement from a stowed position folded around said fuselage to an aligned load sustaining position spaced from said fuselage, pressure operated actuating means connected to said panels for operation thereof, fluid pressure means carried by said fuselage, valve means connecting said fluid pressure means with said actuating means when energized to move said panels to said load sustaining position, regulating means for limiting the rate of operation of said pressure means thus minimizing the effect of external forces applied to said panels on the rate of movement of said panels, a pair of control members swingably carried by said panels adjacent the trailing edge thereof, actuating means operatively connecting with said control members, a solenoid control valve connecting said actuating means with said fluid pressure means for differential operation of said control members, a source of electrical potential, gyro control means for connecting said source of electrical potential to said solenoid valve for energizing the same and thereby controlling the movement of said control members for guiding said missile, and stabilizing fins carried by said fuselage for aerodynamically stabilizing said missile.

6. A glide bomb adapted to be carried by an aircraft and be released therefrom to glide along a selected path to a target comprising, an elongated fuselage, a sustaining wing carried by said fuselage, tail fins carried by said fuselage for movement from a fixed position generally aligned with the fuselage longitudinal axis to a canted position angularly offset from the aligned position, and means for simultaneously releasing said sustaining wing and canting said tail fins for producing a couple causing said bomb to spin about its longitudinal axis whereby a radial velocity is imparted to destructive material released therefrom.

7. A glide bomb adapted to be carried within the bombay of an aircraft like a convential bomb and be released therefrom to glide along a selected path to a target comprising, an elongated fuselage, a plurality of panels swingably carried by said fuselage for movement from a fixed stowed position folded around said fuselage to a generally aligned sustaining position, actuating means for moving said panels to the load sustaining position, means for guiding said bomb, tail fins carried by said fuselage for movement from a position generally aligned with the longitudinal axis thereof for stabilizing said bomb to a canted position angularly offset from the aligned position, means for simultaneously releasing said panels and canting said tail fins whereby said bomb is caused to dive steeply and spin about its longitudinal axis for imparting a radial velocity to material released therefrom.

* * * * *